US008157603B2

(12) United States Patent
Trico

(10) Patent No.: US 8,157,603 B2
(45) Date of Patent: Apr. 17, 2012

(54) ELECTRICAL SCREW TERMINAL, BLOCK COMPRISING ONE SUCH ELECTRICAL TERMINAL AND ELECTRICAL APPARATUS COMPRISING ONE SUCH TERMINAL BLOCK

(75) Inventor: Jean-Marie Trico, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 12/737,315

(22) PCT Filed: May 18, 2009

(86) PCT No.: PCT/FR2009/000587

§ 371 (c)(1),
(2), (4) Date: Dec. 29, 2010

(87) PCT Pub. No.: WO2010/004100

PCT Pub. Date: Jan. 14, 2010

(65) Prior Publication Data

US 2011/0159749 A1 Jun. 30, 2011

(30) Foreign Application Priority Data

Jun. 30, 2008 (FR) ..... 08 03646

(51) Int. Cl.
*H01R 4/36* (2006.01)

(52) U.S. Cl. ..... 439/810

(58) Field of Classification Search ..... 439/810–815
See application file for complete search history.

(56) References Cited

U.S. PATENT DOCUMENTS

| | | | | |
|---|---|---|---|---|
| 2,269,866 | A * | 1/1942 | Simon | 378/152 |
| 3,124,409 | A * | 3/1964 | Nisula | 439/791 |
| 5,376,024 | A * | 12/1994 | Sako et al. | 439/813 |
| 6,231,405 | B1 * | 5/2001 | Diconne et al. | 439/812 |
| 6,280,264 | B1 * | 8/2001 | Whipple et al. | 439/814 |
| 6,942,527 | B1 * | 9/2005 | Lias et al. | 439/814 |
| 7,404,745 | B1 * | 7/2008 | Wu | 439/811 |

FOREIGN PATENT DOCUMENTS

| | | | |
|---|---|---|---|
| EP | 0687032 | B1 | 8/1998 |
| EP | 0758804 | B1 | 3/2000 |
| EP | 0896387 | B1 | 12/2000 |
| FR | 641 163 | A | 7/1928 |
| FR | 2 777 703 | A | 10/1999 |
| WO | WO 2005/064094 | A | 7/2005 |

* cited by examiner

*Primary Examiner* — Briggitte R Hammond
(74) *Attorney, Agent, or Firm* — Steptoe & Johnson LLP

(57) ABSTRACT

An electrical screw terminal comprising a metal tunnel through which an elongate passage runs designed to receive a connection strip and comprising a tapped hole passing through a wall of said tunnel. The terminal comprises a telescopic screw passing through the tapped hole and comprising an operating head designed to be actuated to command said screw, a tightening head designed to clamp an electrical conductor and the connection strip. The telescopic screw comprises at least a first section having an external thread designed to collaborate with the tapped hole and having an internal thread designed to collaborate with an external thread of at least a second cylindrical section. The operating head comprises a single driving profile to drive said sections together in rotation via drive means.

11 Claims, 4 Drawing Sheets

ELECTRICAL SCREW TERMINAL, BLOCK COMPRISING ONE SUCH ELECTRICAL TERMINAL AND ELECTRICAL APPARATUS COMPRISING ONE SUCH TERMINAL BLOCK

This application is a national stage entry of International Application No. PCT/FR2009/000587, filed May 18, 2009 designating the U.S., which claims the benefit of French Application No. 08 03646, filed Jun. 30, 2008.

BACKGROUND OF THE INVENTION

The invention relates to an electrical screw terminal comprising a metal tunnel through which an elongate passage runs designed to receive a connection strip of an electrical apparatus. The tunnel comprises a tapped hole passing through a wall of said tunnel. A telescopic screw passing through the tapped hole comprises an operating head designed to be actuated to command said screw and comprises a tightening head designed to clamp an electrical conductor and the connection strip. The telescopic screw comprises at least a first cylindrical section having an external thread designed to collaborate with the tapped hole and having an internal thread designed to collaborate with an external thread of at least a second cylindrical section.

The invention also relates to a terminal block comprising one such screw terminal and an electrical apparatus comprising one such terminal block.

STATE OF THE PRIOR ART

Numerous Patents EP0896387B1, EP0758804B1, EP0687032B1, FR2777703 describe screw terminals designed for electrical switchgear apparatuses.

Among these existing solutions, the solution provided by the applicant described in the document FR2777703 and represented in FIG. 1 comprises a screw terminal 1 designed to be fitted in a housing 2 provided in the rear part of an electrical apparatus, in particular of a switchgear device 3, to perform connection of an electrical conductor 6 on the connection strip 4 of the device. This terminal is mainly formed by a tunnel 5 formed from a metal block of substantially parallelepipedic shape comprising an elongate opening 5*b* designed to receive the above-mentioned strip 4. The tunnel 5 can also be formed by a portion of metal strip cut and folded into a loop in the form of a substantially rectangular ring.

Said strip is designed to be engaged transversely in the, for example substantially rectangular, elongate opening 5*b* of the tunnel 5.

Said tunnel 5 comprises a tapped hole at the top part thereof, into which hole a screw 7 called terminal screw is screwed to achieve securing of the conductor 6 on the strip 4.

The terminal screw 7 comprises an operating head, a threaded body and a neck joining the threaded body to the head. The threaded body, or a non-threaded extension of this body, is terminated at the free end thereof by a bearing part such as a pad 8. The pad is situated inside the terminal 5 and is designed to collaborate with the strip 4

The terminal screw 7 is preferably accessible via the top part of the switchgear device 3.

The length of the screw is directly proportional to the clamping capacity of the screw terminal. The greater the clamping capacity, in other words the greater the diameter of the conductors to be clamped or the more conductors there are to be clamped, the larger the elongate opening and the longer the terminal screw. This implies larger overall dimensions of the screw terminal when said terminal is not used pending tightening.

The solution as described in the document U.S. Pat. No. 6,280,264B1 solves some of the problems brought up in the above by proposing a telescopic clamping screw. The telescopic clamping screw composed of two sections of the same length thereby enables the dimensions of the screw terminal to be reduced for a relatively high clamping capacity. According to this embodiment, the height of the screw is substantially reduced by two thereby enabling the total height of the non-tightened terminal to be reduced by one third.

However, this type of telescopic screw presents a certain number of drawbacks. Each section of the screw in fact comprises its own driving profile. Each driving profile being independent, the user has to actuate all the driving profiles to guarantee efficient tightening. The driving order of the different sections is also of prime importance to guarantee efficient tightening. Furthermore, several different tools have to be used to respectively handle the driving profiles.

SUMMARY OF THE INVENTION

The object of the invention is therefore to remedy the drawbacks of the state of the art so as to propose a screw terminal having a large clamping capacity and having smaller dimensions.

The electrical screw terminal according to the invention comprises an operating head having a single driving profile designed to collaborate with an external tool to drive said at least first and said at least second sections of the telescopic screw together in rotation via drive means.

Said driving profile is preferably positioned at a first end of said at least second cylindrical section and the tightening head is positioned at a second end of said at least second cylindrical section.

According to a particular mode of development, the drive means comprise at least one deformable elastic means fitted between the at least first section and the at least second section and being able to deform to secure said sections.

Advantageously, said at least one deformable elastic means comprises a split ring fitted between the inside wall of said at least first section and the outside wall of said at least second section, said ring presenting an external cylindrical surface pressing against the inside wall of said at least first section.

Advantageously, said at least first section comprises a conical inside wall on which the external cylindrical surface of said ring presses, and said at least second section comprises securing means driving said split ring in translation. Movement of the second section results in movement of the external cylindrical surface of the split ring on the slope of the cone to jam said ring between the inside wall of said at least first section and the outside wall of said at least second section.

According to a particular mode of development, the drive means comprise at least one friction surface between an inner surface of said at least first section and an outer surface of said at least second section, said friction surface enabling securing in rotation of one section with respect to the other.

Advantageously, the drive means comprise a male/female cone system, a female part being formed by the inner surface of the first section and a male part being formed by the outer surface of the second section, said at least one friction surface being situated at the level of the contact area between the male and female parts.

Advantageously, the drive means are designed to drive all the threaded sections of the telescopic terminal screw in rotation either simultaneously or successively.

According to particular embodiment, the telescopic screw comprises two sections, one of the sections comprising a right-handed thread and the other section comprising a left-handed thread.

A terminal block according to the invention comprises at least one electrical screw terminal as defined above. The terminal block comprises at least one internal volume comprising means for positioning said at least one screw terminal in a first position.

Advantageously, the means for positioning are retractable to allow movement of said at least one electrical terminal in the internal volume of the terminal block, movement from the first position to a second position.

Advantageously, the terminal block comprises several internal volumes separated from one another by insulating separating cheeks.

An apparatus electrical according to the invention comprises a terminal block as defined above. The terminal block comprises an internal volume comprising means for positioning designed to secure said at least one screw terminal in a first position.

BRIEF DESCRIPTION OF THE DRAWINGS

Other advantages and features will become more clearly apparent from the following description of particular embodiments of the invention, given for non-restrictive example purposes only and represented in the accompanying drawings in which.

DETAILED DESCRIPTION OF AN EMBODIMENT

Figure 1:
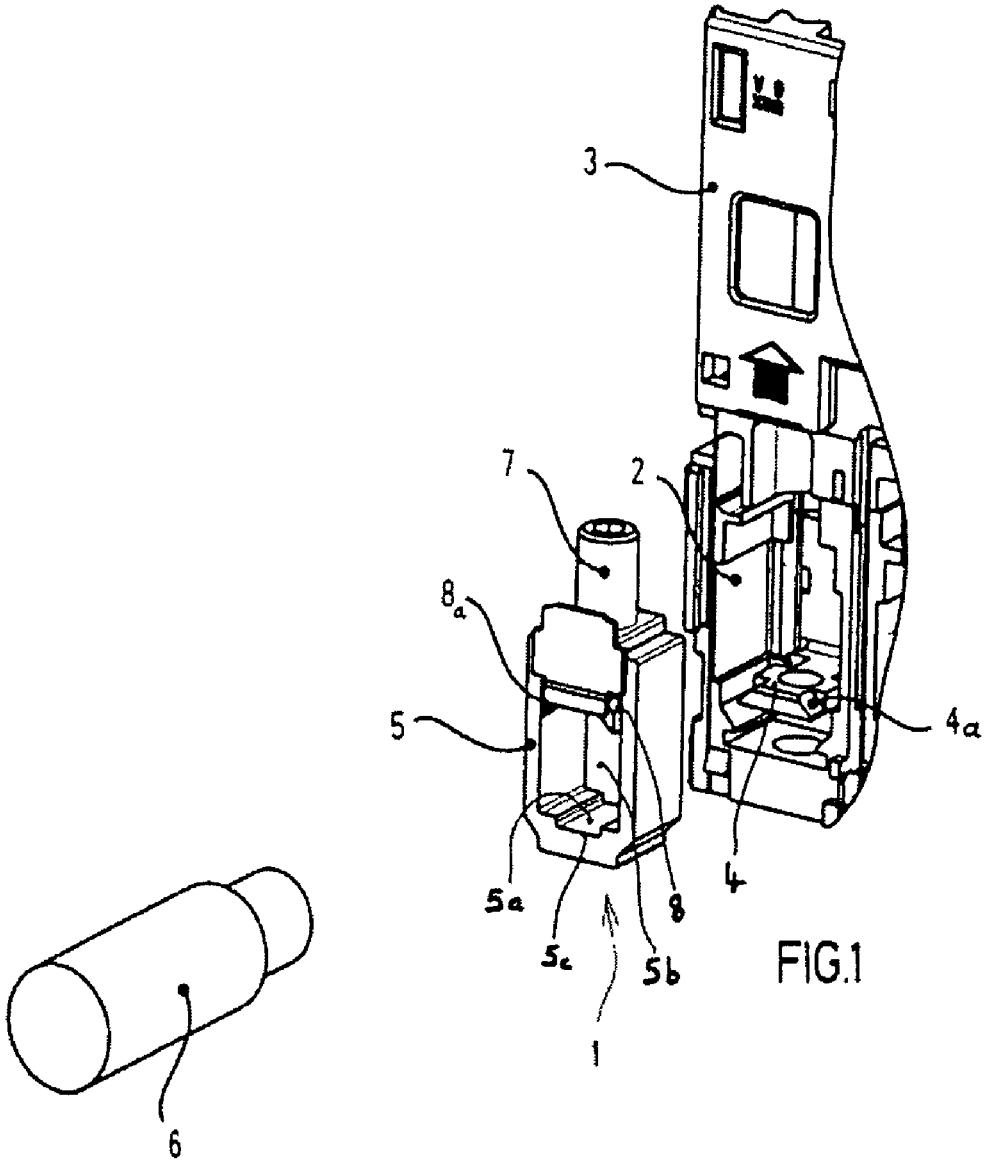
Fig. 1 (Prior art)
FIG. 1 represents a perspective view of a screw terminal according to a known embodiment.
Figure 2A:
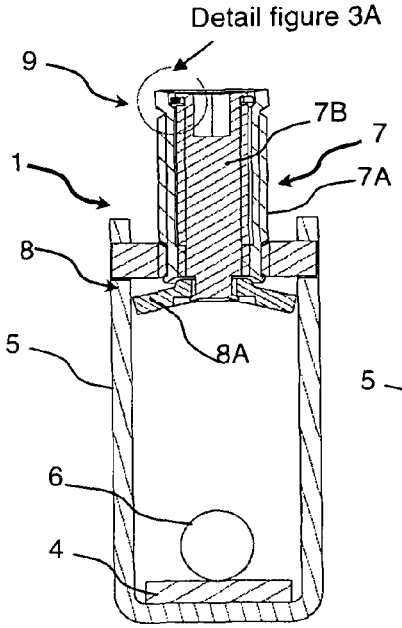
FIGS. 2A to 2C represent axial cross-sections of a screw terminal according to an embodiment of the invention in different securing positions.
Figure 2B:
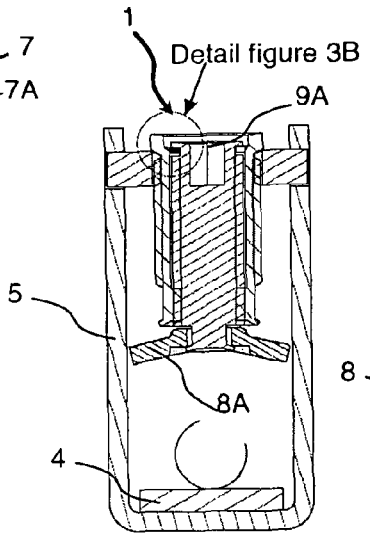
Figure 2C:
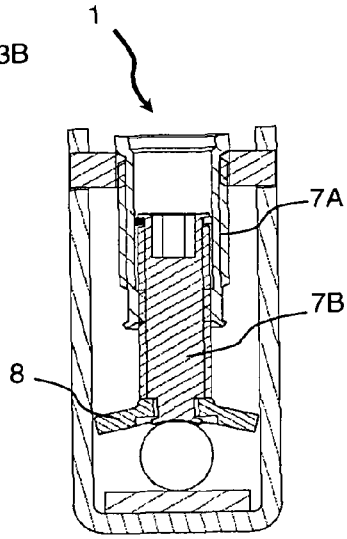

With reference to FIGS. 2A, 2B and 2C, according to a preferred embodiment, the electrical screw terminal 1 comprises a metal tunnel 5 through which an elongate passage runs designed to receive a connection strip 4 of an electrical apparatus. The electrical screw terminal 1 is in particular designed to connect electrical switchgear apparatuses, in particular circuit breakers, to electrical conductors.

The tunnel 5 comprises a tapped hole passing through a wall of said tunnel. As an example embodiment, the tunnel 5 is made from a flat metal part folded into a U. The two ends of the branches of the U are joined by a metal cross-member in which the tapped hole is made.

The electrical screw terminal 1 comprises a telescopic screw 7 designed to clamp an electrical conductor 6 and the connection strip. The telescopic screw 7 comprises at least a first cylindrical section 7A having an external thread designed to collaborate with the tapped hole. Said section also comprises an internal thread designed to collaborate with an external thread of at least a second cylindrical section 7B. The cylindrical sections are coaxial and concentric.

The telescopic screw 7 comprises an operating head 9 designed to be actuated for tightening said screw.

The telescopic screw 7 further comprises a tightening head 8 designed to apply a clamping force on the connection strip 4 and the electrical conductor. The tightening head 8 of the telescopic screw 7 comprises a clamping profile 8A designed to collaborate with the electrical conductor 6 to be clamped on the connection strip 4. The clamping profile 8A is preferably positioned at a second end of said at least second cylindrical section 7B.

Figure 4:
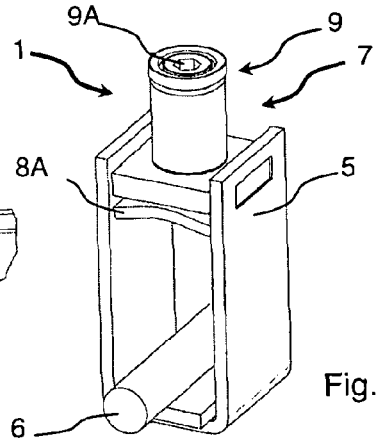
FIG. 4 represents a perspective view of a screw terminal according to an embodiment of the invention.

According to the preferred embodiment, the operating head 9 of the telescopic screw 7 comprises a single driving profile 9A. Said driving profile 9A is designed to collaborate with an external tool such as a spanner used by a fitter. The single driving profile 9A is preferably positioned at a first end of said at least second cylindrical section 7B. As an example embodiment represented in FIG. 4, the driving profile 9A is hollow and is of hexagonal shape.

The operating head 9 further comprises drive means 9B designed to drive all the sections 7A, 7B of the telescopic screw 7 together in rotation by the driving profile 9A.

According to this embodiment, clamping of the electrical conductor 6 and of the connection strip 4 is always performed by said at least second section 7B via the clamping profile 8A.

As an example embodiment as represented in FIGS. 2A, 2B and 2C, the telescopic screw 7 comprises two cylindrical sections 7A, 7B.

Figure 3A:
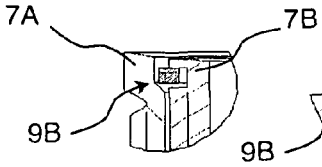
FIGS. 3A and 3B represent detailed axial cross-sectional views of the drive means of the screw terminal respectively according to FIGS. 2A and 2B.
Figure 3B:
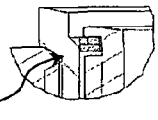

According to a first particular embodiment of the invention, the drive means 9B of the operating head 9 comprise a deformable flexible means fitted between said at least first section 7A and said at least second section 7B. Said flexible means are able to deform to secure said sections. Deformation of said at least flexible means is generated by movement of one of the two sections 7B. As an example embodiment as represented in FIGS. 3A and 3B, said deformable flexible means comprise a split ring fitted between the inside wall of said at least first section 7A and the outside wall of said at least second section 7B.

Said ring presents an external cylindrical surface pressing against the inside wall of said at least first section 7A. Said at least first section 7A preferably comprises a conical inside wall on which the external cylindrical surface of said ring presses.

Said at least second section 7B comprises securing means driving said split ring in translation. As an example embodiment, the outside wall of said at least second section 7B comprises at least one rim to secure the split ring axially to said section. The split ring is preferably positioned in a groove placed on the external perimeter of said at least second section 7B. Said groove enables expansion of the ring when movement of second section 7B takes place with respect to the first section.

The method for securing an electrical conductor 6 with the connection strip 4 is as follows. Movement of each section takes place between two movement stops. A first stop corresponds to a position of the section in the non-tightened position. A second stop corresponds to a position of the section when the latter is moved over the whole length of its external thread from a non-tightened position to a tightened position. The movement stops of said at least first section 7A collaborate with the tunnel 5 of the electrical screw terminal. The movement stops of said at least second section 7B preferably collaborate with said at least first section 7A.

Movement of said at least second section 7B, via the driving profile 9A, results in movement of the external cylindrical surface of the split ring on the slope of the cone to jam said ring between the inside wall of said at least first section 7A and the outside wall of said at least second section 7B. Jamming of said ring between the two walls of the two sections 7A, 7B enables said two sections to be secured so that driving in rotation of the second section 7B results in rotation of the first section 7A. In other words, tightening of the first section 7A is achieved by means of actuation of the driving profile 9A placed at the end of the second cylindrical section 7B.

Movement of the telescopic screw 7 via the operating head 9 results in movement of all the sections due to the presence of drive means 9B and of driving profile 9A. In a first step, the telescopic screw 7 is not deployed, said at least first section 7A moves between its first and second movement stop, said at least second section 7B not moving with respect to said at least first section 7A. If first section 7A reaches the second movement stop and clamping between the strip 4 and conductor 6 is not performed, the tightening torque applied on the operating head 9 will lead to second section 7B being deployed which will in turn move between its first and second movement stop. Dimensioning of the tunnel 5 and of the length of the telescopic screw 7 are such that the second stop of the second section 7B is not reached before clamping has been performed.

According to a second particular mode of development of the invention, the drive means comprise at least one friction surface between an inner surface of said at least first section 7A and an outer surface of said at least second section 7B. Said friction surface enables blocking in rotation of one section with respect to the other. The drive means thus comprise a male/female cone system. A female part is formed by an inner surface of the first section 7A and a part male is formed by the outer surface of the second section 7B. Said at least one friction surface is then located at the level of the contact area between the male and female parts. Before use, the sections can be joined to one another by applying a torque in the slackening direction via the driving profile 9A. The friction surface then plays a similar role to that of said at least one deformable flexible means described in the above.

In this way, unlike solutions of the state of the art, this tightening order is imposed by the use of a single driving profile 9A and the presence of drive means 9B. This guarantees effective clamping of the conductor 6 whatever its diameter.

Figure 5A:
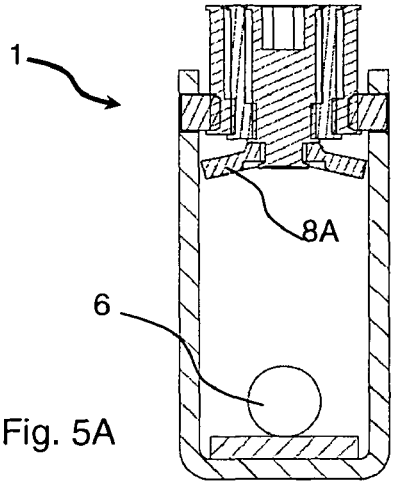
FIGS. 5A and 5B represent axial cross-sections of an alternative embodiment of a screw terminal according to an embodiment of the invention in different securing positions.
Figure 5B:
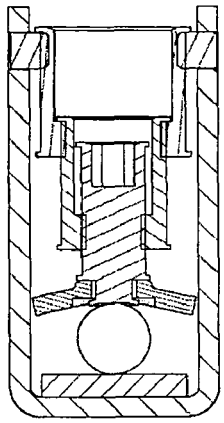

According to a first variant of the embodiments of the invention as represented in FIGS. 5A and 5B, the telescopic screw 7 comprises three cylindrical sections. Operation for a telescopic screw 7 with three sections is similar to that of a telescopic screw 7 with two sections.

According to another alternative embodiment, the second end of said at least second section 7B preferably comprises a clamping V. The clamping V positioned substantially perpendicularly to the cylindrical section achieves a better distribution of the clamping force on the electrical conductor. The clamping V can be joined to the second end of the second section 7B via a swivel joint.

According to an alternative embodiment, the drive means 9B are designed to drive all the threaded sections of the telescopic terminal screw simultaneously in rotation.

According to an alternative embodiment, the drive means 9B are designed to drive all the threaded sections of the telescopic terminal screw successively in rotation.

According to an alternative embodiment, said at least first section 7A comprises a different internal thread from the external thread. Relative movement of the first section 7A in the tapped hole is then performed at a different speed from the relative movement of said at least second section 7B with respect to the first section.

According to an alternative embodiment, said at least first section 7A comprises a right-threaded internal thread and a left-threaded external thread.

Figure 6:
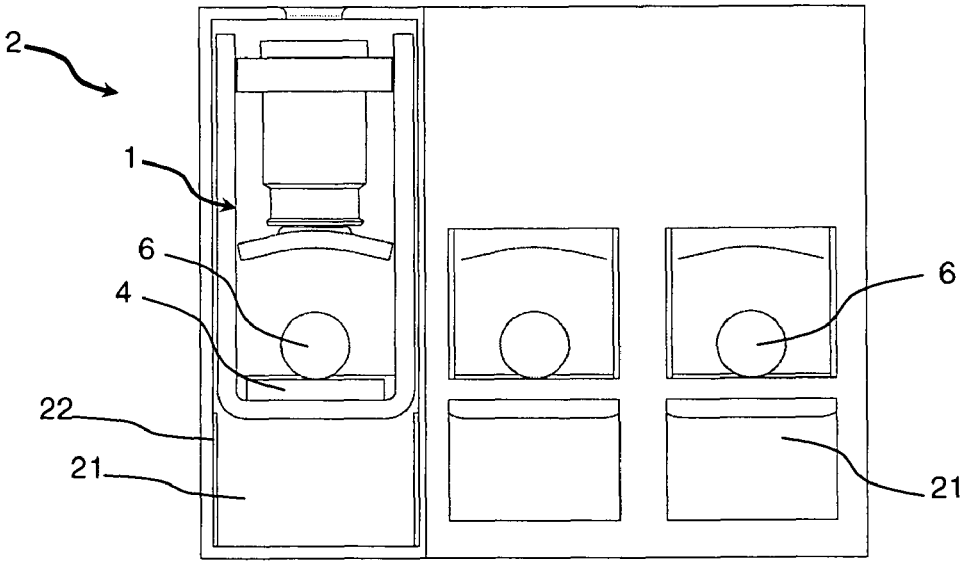
FIG. 6 represents an axial cross-section of a three-phase terminal block according to an embodiment of the invention.
Figure 7:
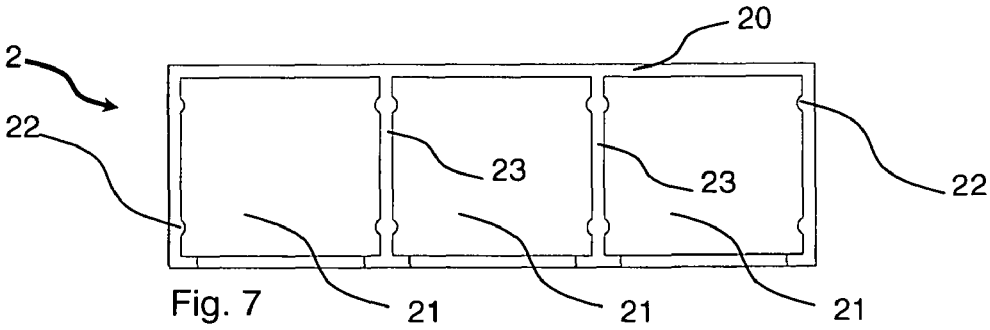
FIG. 7 represents a detailed view of a terminal block according to FIG. 6.
Figure 8:
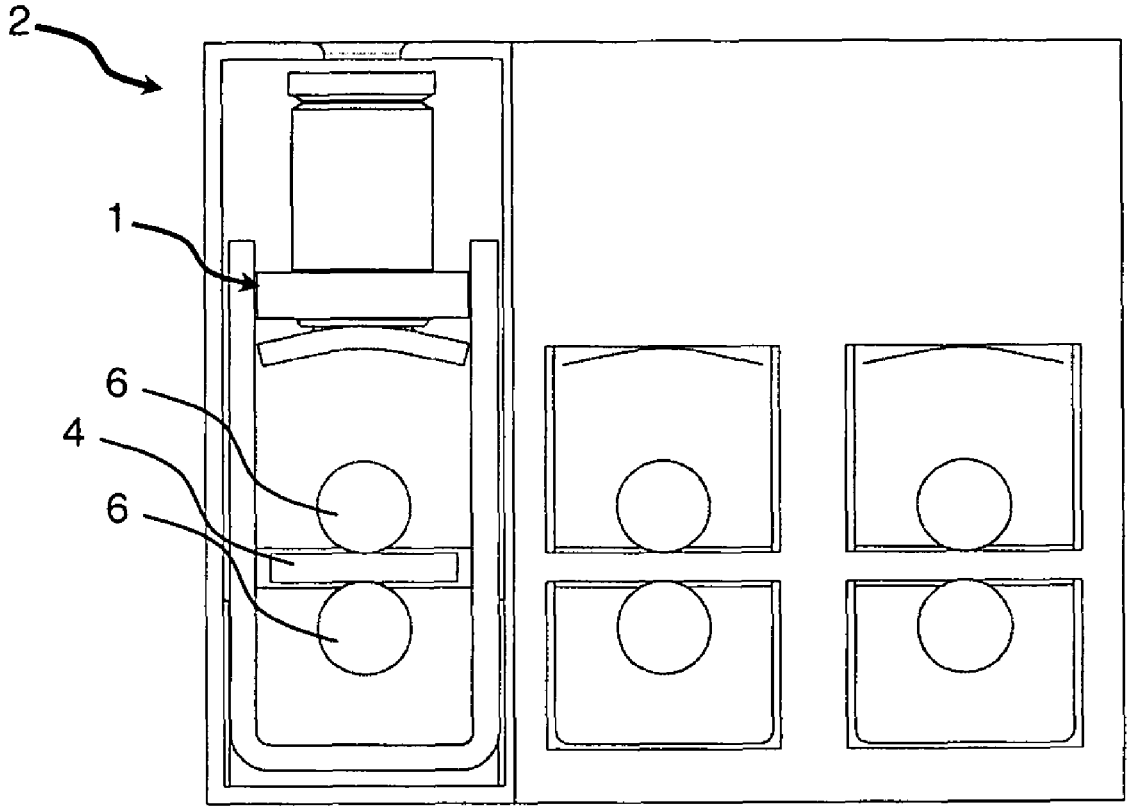
FIG. 8 represents an axial cross-section of a terminal block according to another embodiment of the invention.

As represented in FIGS. 6 and 8, the invention concerns a terminal block 2 comprising at least one electrical screw terminal 1 as defined below. The terminal block of substantially parallelepipedic shape is preferably made from moulded plastic. Said terminal block 2 comprises a wall 20 delineating at least an internal volume 21. Inside the internal volume 21, the terminal block comprises means for positioning 22 the electrical screw terminal 1 in a first position. As represented in FIGS. 6 to 8, as an example embodiment, the terminal block is three-phase and comprises three internal volumes 21 respectively comprising a screw terminal 1. The internal volumes 21 are separated from one another by separating cheeks 23 made from insulating material.

The means for positioning 22 are preferably retractable to enable positioning of said at least one electrical screw terminal 1 in a second position. According to the mode of development, the means for positioning 22 comprise small protuberances moulded in the wall of the terminal block. For example purposes, as represented in FIG. 7, each internal volume 21 comprises four protuberances having the form of a half-column placed on two walls of each internal volume 21.

As represented in FIG. 6, each electrical screw terminal 1 is placed in the first position when tightening is to be performed between a fixed connection strip 4 of an electrical apparatus and a single electrical conductor 6.

As represented in FIG. 8, each electrical screw terminal 1 is placed in the second position when tightening is to be performed between a fixed connection strip 4 of an electrical apparatus and two electrical conductors 6.

To go from the first position to the second position, the user has to slacken off the telescopic screw 7 using a tool. In a first step, said screw moves and presses on the wall 20 of the terminal block 2. In a second step, the screw no longer being able to move, the metal tunnel 5 then moves in the opposite direction calking the means for positioning 22. The means for positioning 22 are crushed and allow movement of the tunnel 5 which reaches the second position. The clamping capacity of the terminal is then maximum.

The invention concerns an electrical apparatus, in an electrical switchgear apparatus such as a contactor, circuit breaker or switch. Said apparatus comprises at least one terminal block 2 as defined below. Said terminal block 2 has an internal volume comprising means for positioning 22 designed to secure said at least one screw terminal 1 in a first position. Said apparatus further comprises securing means enabling the terminal block 2 to be fixed in removable manner on said apparatus.

The invention claimed is:

1. An electrical screw terminal comprising:

a metal tunnel through which an elongate passage runs for receiving a connection strip of an electrical apparatus, and having a tapped hole passing through a wall of said tunnel, and a telescopic screw passing through the tapped hole and comprising:

at least a first cylindrical section having an external thread complementary with the tapped hole and having an internal thread for cooperating with an external thread of at least a second cylindrical section, an operating head comprising a driving profile for cooperating with an external tool for commanding the telescopic screw, a tightening head for clamping an electrical conductor and the connection strip, wherein the operating head comprises a single driving profile positioned at a first end of said at least second cylindrical section, said driving profile for cooperating with an external tool for driving said at least first and second sections together in rotation via drive means, the tightening head being positioned at a second end of said at least second cylindrical section, and the drive means comprise a deformable flexible means fitted between the at least first section and the at least second section, and able to deform to secure said sections.

2. The electrical screw terminal according to claim 1, wherein the drive means are for driving all the threaded sections of the telescopic terminal screw simultaneously or successively in rotation.

3. The electrical screw terminal according to claim 1, wherein the telescopic screw comprises two sections, one of the sections comprising a right-handed thread and the other section comprising a left-handed thread.

4. The electrical screw terminal according to claim 1, wherein said deformable flexible means comprise a split ring between the inside wall of said at least first section and the outside wall of said at least second section, said ring having an external cylindrical surface pressing against the inside wall of said at least first section.

5. The electrical screw terminal according to claim 4, wherein:

said at least first section comprises a conical inside wall on which the external cylindrical surface of said ring presses, and said at least second section comprises means for driving said split ring in translation, so that movement of the second section results in movement of an external cylindrical surface of the split ring on the slope of a cone to jam said ring between the inside wall of said at least first section and the outside wall of said at least second section.

6. A terminal block comprising at least one electrical screw terminal according to claim 1, and means for positioning said at least one screw terminal in a first position.

7. The terminal block according to claim 6, comprising several internal volumes separated from one another by insulating separating walls.

8. The terminal block according to claim 6, wherein the means for positioning are retractable for enabling movement of said at least one electrical terminal from a first position to a second position.

9. An electrical apparatus comprising at least one terminal block according to claim 8, wherein the terminal block includes means for positioning and securing said at least one screw terminal in a first position.

10. An electrical screw terminal comprising:

a metal tunnel through which an elongate passage runs for receiving a connection strip of an electrical apparatus, and having a tapped hole passing through a wall of said tunnel, and a telescopic screw passing through the tapped hole and comprising:

at least a first cylindrical section having an external thread complementary with the tapped hole and having an internal thread for cooperating with an external thread of at least a second cylindrical section, an operating head comprising a driving profile for cooperating with an external tool for commanding the telescopic screw, a tightening head for clamping an electrical conductor and the connection strip, wherein the operating head comprises a single driving profile positioned at a first end of said at least second cylindrical section, said driving profile for cooperating with an external tool for driving said at least first and second sections together in rotation via drive means, the tightening head being positioned at a second end of said at least second cylindrical section, and the drive means comprise at least one friction surface between an inner surface of said at least first cylindrical section and an outer surface of said at least second cylindrical section, said friction surface for blocking of one section in rotation with respect to the other.

11. The electrical screw terminal according to claim 10, wherein the drive means comprise a male/female cone system, a female part being the inner surface of the first section and a male part being the outer surface of the second section, said at least one friction surface being at the level of the zone contact area between the male and female parts.

* * * * *